United States Patent [19]

Christensen et al.

[11] 4,190,963

[45] Mar. 4, 1980

[54] CLEANSING DEVICE FOR FLUIDIZED BED REACTORS

[75] Inventors: Mogens A. Christensen, Virum, Denmark; Svend Hovmand, Ellicott City, Md.; Jens K. Laursen, Holte; Henrik B. Mortensen, Birkerød, both of Denmark

[73] Assignee: A/S Niro Atomizer, Søborg, Denmark

[21] Appl. No.: 880,744

[22] Filed: Feb. 24, 1978

[30] Foreign Application Priority Data

Feb. 25, 1977 [DK] Denmark ..... 830/77

[51] Int. Cl.[2] ..... F26B 3/08

[52] U.S. Cl. ..... 34/57 A; 34/85; 34/57 D; 159/4 CC

[58] Field of Search ..... 55/120, 474; 15/304; 165/95; 34/57 R, 57 A, 57 D, 85; 134/172; 159/4 R, 4 CC

[56] References Cited

U.S. PATENT DOCUMENTS

| | | | |
|---|---|---|---|
| 1,946,566 | 2/1934 | Bowen | 159/4 |
| 2,761,769 | 9/1956 | Elder | 34/57 D |
| 3,780,445 | 12/1973 | Hansen | 34/57 D |
| 4,018,262 | 4/1977 | Jaschinski et al. | 34/57 D |
| 4,075,766 | 2/1978 | Michel et al. | 34/57 D |

FOREIGN PATENT DOCUMENTS

| | | |
|---|---|---|
| 887178 | 8/1953 | Fed. Rep. of Germany . |
| 2315879 | 10/1973 | Fed. Rep. of Germany . |
| 1176993 | 1/1970 | United Kingdom . |
| 1265770 | 3/1972 | United Kingdom . |
| 452735 | 5/1975 | U.S.S.R. . |

*Primary Examiner*—Larry I. Schwartz

*Attorney, Agent, or Firm*—Sughrue, Rothwell, Mion, Zinn and Macpeak

[57] ABSTRACT

In the chamber of a fluidized bed reactor for processing powdered products, a pneumatic cleansing device is arranged which comprises at least one pipe member mounted to be movable parallel to a perforated powder supporting plate at a small distance from the upper side thereof and having nozzles for ejecting air or gas towards the supporting plate to remove depositions of material from the upper side thereof between the perforations in the plate through which a fluidization gas flows upwardly to form a fluidized powder layer overlying the plate. The cleansing device may comprise additional pipe members with nozzles for ejecting air or gas towards the side wall and ceiling of the chamber and may be constructed for use in a box-shaped chamber as well as a cylindrical chamber for fluidized bed reactors of the plug-flow or spray granulation types.

6 Claims, 6 Drawing Figures

CLEANSING DEVICE FOR FLUIDIZED BED REACTORS

The present invention relates to fluidized bed reactors for processing powdered products.

BACKGROUND OF THE INVENTION

Normally, a fluidized bed reacting apparatus comprises a chamber having inlet means for the powdered product to be processed and at least one perforated powder supporting plate arranged in a substantially horizontal plane in said chamber, as well as means arranged in a part of the chamber below said plate for producing a flow of gas upwardly through the perforations in said plate for the formation of a fluidized layer of said product through part of the height of said chamber overlying the perforated plate.

Fluidized bed reactors of this kind are widely used in industry for drying processes, which are often carried out in combination with an agglomeration or granulation of powdered products. Furthermore, such reactors may be used for other physical or chemical reaction processes, such as certain polymerization processes.

In principle, the mechanism of fluidization is that the particles contained in the powdered product overlying the perforated supporting plate are brought in a kind of floating, air-borne condition by means of the upwardly directed fluidization gas flow, so that the material behaves in a manner like a boiling liquid.

Fluidized bed reactors are constructed for discontinuous as well as continuous operation. In the simple case of discontinuous operation, in which a quantity of powdered material is processed for a certain period and is, subsequently, removed in one operation by evacuation of the apparatus, a single-stage reactor may often be used comprising a single powder supporting plate in the chamber.

In continuous operation, two main types of fluidized bed reactors are used, viz. the so-called back-mixed fluid bed reactor, or the plug-flow fluid bed reactor.

In the back-mixed type of fluid bed reactor, the composition of the powdered product is the same throughout the fluidized bed or layer and is identical to the composition of the final product. This reactor type will be useful for processing a starting material which is not in itself suitable for fluidization, provided that a sufficient distribution of the material across the fluidized bed can be obtained by feeding the material.

In the plug-flow reactor type, which may be constructed so that the fluidized bed has a very great length relative to its width, the composition of the powdered material varies from the inlet position towards the powder outlet of the apparatus. This reactor type is particularly useful when the process in the apparatus is taking place at a decreasing velocity, such as when drying to a low residial humidity. Fluidized bed reactors of the plug-flow type may also comprise a chamber having a circular cross-section, in which a spiral guiding wall is arranged upon the powder supporting plate, so that during the process, the powdered material flows continuously through the helical path formed by said wall after being fed in the central part of the chamber or at the outer wall thereof.

A process of a character similar to that taking place in reactors of the plug-flow type may also be obtained by a series arrangement of a number of single-stage reactors.

In some cases, fluidization may be combined with atomization of a liquid which may either, in so-called spray granulation, contain the product per se to be dried, or may serve for humidification or agglomeration of the fluidized powder.

This atomization is carried out by means of one or more atomizers which are normally arranged in the upper part of the chamber, and to which the liquid is supplied by inlet means extending through the ceiling of the chamber.

In case of products showing a very great variation with respect to particle sizes or shapes, or being otherwise difficult to fluidize, the fluidization may also be carried out in a vibrating, normally oblong chamber with product inlet means in one end and outlet means in the opposite end.

Frequently, it may be desired to use a fluidized bed reacting apparatus for processing products which show a tendency to adhesion and, consequently, to agglomeration even in a nearly dry condition, whereby depositions of such materials are often formed on the wall and ceiling faces of the reactor chamber, or on the perforated supporting plate. Such depositions are undesired and have to a certain degree led to restrictions with respect to the kind of products which may efficiently be processed in fluidized bed reactors.

In particular, depositions of the kind mentioned, on the upper side of the perforated plate may have the consequence that relatively high deposits are built up on the plate between the perforations to be passed by the fluidization gas, since the particle concentration in the fluidized bed is very high.

DESCRIPTION OF THE PRIOR ART

In U.S. Pat. No. 3,780,445, a pneumatic cleansing device has been disclosed, comprising a rotating cleansing arm arranged below the perforated supporting plate to clean the underside thereof for depositions which may have been formed by fine particles or dust carried by the fluidization gas and entailing the risk of blocking the perforations in the supporting plate. This is, particularly, a problem occurring in multi-stage reactors having a number of powder supporting plates arranged above each other in a common chamber, so that the same flow of fluidization gas is utilized in a number of successive stages, or in reactors in which the fluidization gas is recirculated to flow several times through the same supporting plate.

In German published specification No. 2,315,879, it has been suggested in order to avoid depositions of material on the chamber walls above the fluidized bed to provide the chamber with a horizontal, circumferential air channel immediately above the fluidized layer, from which channel air flows may be ejected upwardly along the chamber walls through slots slanting at a rather great inclination. Thereby, the construction of the chamber is made complicated and expensive without the tendency to depositions on the supporting plate and the lower part of the chamber walls outside the fluidized layer being removed. Furthermore, this solution puts heavy demands on energy to the relatively great quantity of air, which must necessarily be supplied to the slots.

In British Pat. No. 1,265,770, another fluidized bed reactor is known, incorporating a stationary, annular pipe having fixed nozzles for the ejection of air flows in the area at the circumference of the perforated powder supporting plate in order to avoid a defluidized zone in this area. Thus, neither this prior art construction represents a solution as to how to avoid a tendency to depositions of material internally on the perforated plate.

In USSR inventor's certificate No. 452,735, a further fluid bed reactor has been disclosed, comprising a conical chamber, the cross-sectional area of which is upwardly decreasing, and a powder supporting plate of a very small area, wherein air is blown from a central, vertical rotating pipe channel through a number of tubes of an elastic material and having varying length in order to avoid material depositions on the conical walls of the chamber. In practice, such a solution will have no effect against material depositions on the upper side of the powder supporting plate.

In spray drying reactors it is known per se from German Pat. No. 887,178, British Pat. No. 1,176,993 and U.S. Pat. No. 1,946,566 to use rotating, pneumatic cleansing arms for the removal of material depositions from the wall and bottom faces in drying chambers, and as evacuation means for outlet of the dried material.

However, in practice, no satisfactory solution has hitherto been presented to the difficult problems with respect to material depositions occurring particularly in case of certain powdered materials showing a heavy tendency to agglomeration, or containing large particles of an uneven shape. Especially in the latter case, problems would occur with respect to material depositions on the perforated powder supporting plate because large particles will have a tendency to be positioned at the bottom of the fluidized layer, whereby they will be subjected to local overheating and a risk of agglomeration or deposition on the supporting plate. It has been attempted to solve the problem by using supporting plates of a porous, sintered, ceramic material which, in practice, however, has appeared to be very disadvantageous, because the passages for the fluidization gas are very easy blocked by particles. As another solution, it has been suggested to form the supporting plate with slanting or curved flow passages for the fluidization gas for deflecting the gas flow across the plate. However, in practice, neither of these solutions have appeared to result in the effect aimed at.

SUMMARY OF THE INVENTION

On the above mentioned background, it is the object of the invention to provide a cleansing device which will be effective for continuous removal of depositions of the kind mentioned during operation of the fluidized bed reactor and, in particular, in the fluidized layer above the powder supporting plate.

According to the invention, effective removal of material depositions from the upper side of the powder supporting plate may be obtained in a fluidized bed reacting apparatus of the kind referred to by means of a movable pneumatic cleansing device, which comprises at least one pipe member overlying the perforated powder supporting plate in parallel relationship to and at a small distance from the upper side thereof, said pipe member being constructed for movement across said plate during operation of said reacting apparatus and having nozzles for ejecting air or gas flows towards the upper side of said plate.

Thereby, an important extension is obtained of the field of applications of fluid bed reactors with respect to the choice of products and the kind of process to be performed. Furthermore, a considerable improvement of the process economy may be obtained as a result of the fact that higher inlet temperatures of the fluidization gas and higher powder temperatures may be used, and because frequent stops for manual cleaning are avoided. The cleansing device according to the invention does not result in any complication of the chamber construction per se, and it may without difficulties be operative in combination with a cleansing arm arranged below the powder supporting plate.

In addition, the cleansing device according to the invention has the advantage that it may be used in all the above mentioned types of fluidized bed reactors. As an example, in a fluidized bed reacting apparatus of the plug flow type comprising a chamber having a cylindrical side wall and a substantially flat ceiling, in which a substantially vertical spiral guiding wall is arranged upon and directly connected with the perforated plate, the pipe member of the cleansing device may constitute the bottom member of a substantially U-shaped pipe configuration arranged for movement in the helical path formed by said guiding wall, the leg members of which U-shaped configuration are constituted by additional pipe members constructed for ejecting air or gas flows towards opposite side faces of successive windings of said guiding wall, said U-shaped configuration being displaceably arranged on an arm which is journalled centrally in said chamber above said guiding wall and in parallel relationship to said perforated plate, said arm being connected with said drive means and means being provided for guiding the movement of said U-shaped configuration relative to the upper edge of said guiding wall during rotation of said arm around the axis of said chamber, stop means for the movement of said U-shaped configuration being provided at the ends of said guiding wall in the central part of said chamber and at the side wall thereof, said drive means being constructed for reversing the rotation of said arm, when said stop means are engaged by said pipe configuration.

The invention is based on the recognition of the fact that in the fluidized layer having a high particle concentration, cleaning of the upper side of the powder supporting plate may, surprisingly, be obtained by means of a movable pneumatic cleansing device which functions, in principle, in the same manner as the known devices, in which rotating cleansing arms are used below the powder supporting plate or in spray drying chambers. The removal of material depositions between the perforations in the powder supporting plate has appeared to be effective in spite of the oppositely directed gas flows through the perforations, and without the intended effect of the fluidization gas being hampered by the cleaning air flows, or the fluidized layer being disturbed by the movement of the cleansing device.

Furthermore, the additional effect is obtained by the cleansing device according to the invention that larger, uneven powder particles having a tendency to be positioned at the bottom of the fluidized layer are stirred up in this layer, so as to be prevented from lying at the bottom of the layer and being subjected to local overheating with the resulting risk of adhesion or deposition on the powder supporting plate.

BRIEF DESCRIPTION OF THE DRAWINGS

In the following, the invention will be explained in further detail with reference to the accompanying drawing, which shows schematically various embodiments of a cleansing device according to the invention, and wherein.

DETAILED DESCRIPTION

Figure 1:
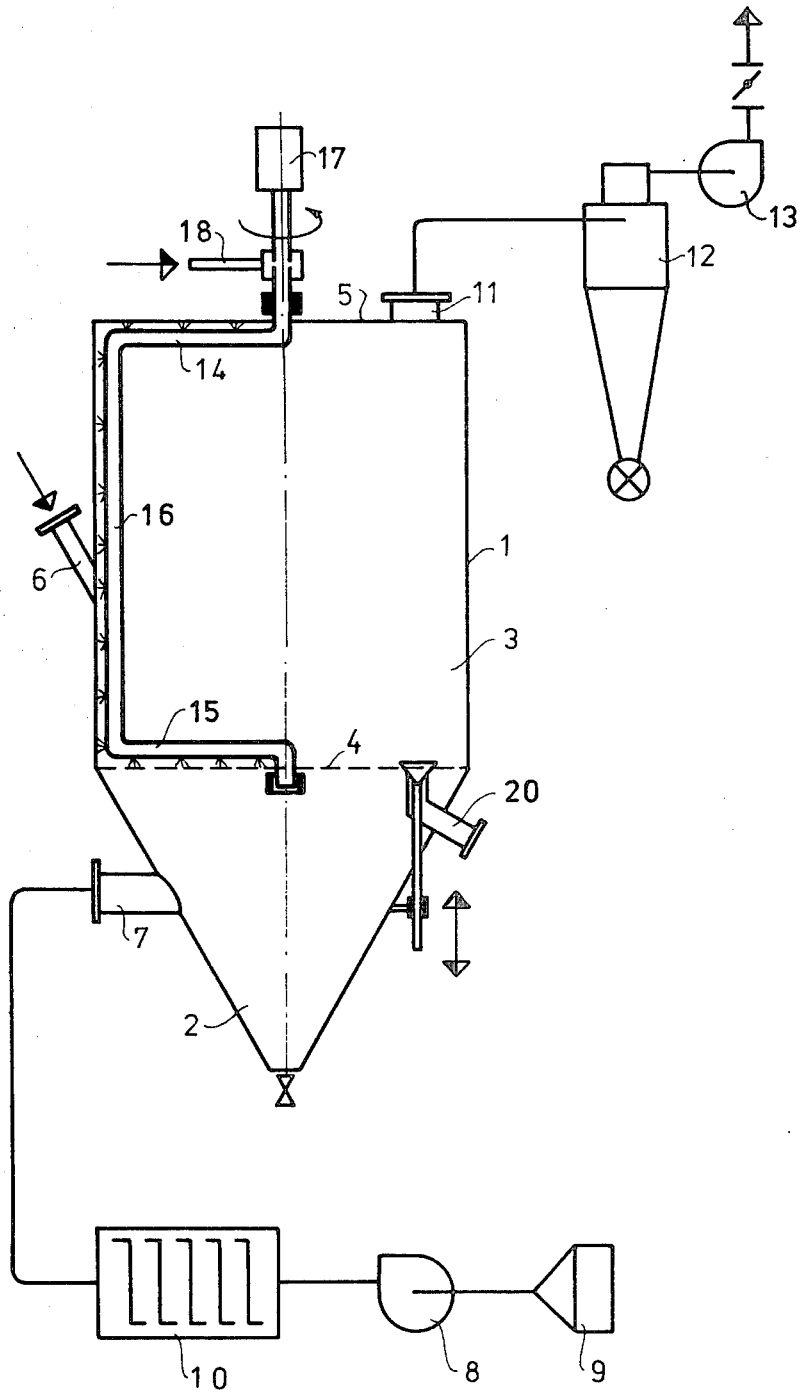
FIGS. 1 and 2 show a single-stage fluid bed reactor.

In FIG. 1, the construction of a single-stage fluid bed reactor is shown in a purely schematical way. Powder processing is taking place in a chamber 1 shown in an axial sectional view and comprising a lower, conical part 2, an upper cylindrical part 3 and, at the junction between said parts in the interior of the chamber, a perforated powder supporting plate 4, whereas in the upper end, the chamber is closed by a ceiling 5.

The powder to be processed is fed into the cylindrical part 3 of chamber 1 through an inlet pipe 6, while the fluidization gas is introduced into the lower conical part 2 of chamber 1 through a gas inlet 7, to which the gas which in this case may be atmospheric air for drying the powder, but may also be some other gas, such as nitrogen, is supplied from a blower 8 with an associated inlet filter 9 for the removal of impurities, and a heating unit 10.

By the passage of the fluidization gas through the perforations in the perforated powder supporting plate 4, a fluidized powder layer containing powder particles in a floating airborne condition is formed at the bottom of the cylindrical part 3 of chamber 1. The height of the fluidized powder layer may amount for instance to about one fourth of the height of the cylindrical part 3 of chamber 1.

The fluidization gas passing through chamber 1 flows through a gas outlet 11 to a cyclone 12, in which powder particles entrained by the gas are separated for reprocessing, whereas the gas is evacuated or possibly recirculated to be used again in the chamber 1 by means of a blower 13.

In order to avoid depositions of powder material on the upper side of the perforated powder supporting plate 4, a pneumatic cleansing device is arranged in chamber 1, which cleansing device, according to the invention, comprises at least one pipe member connected to an air or gas supply means and arranged in parallel relationship to and at a small distance from the upper side of the powder supporting plate, said pipe member being constructed for movement across the plate 4 during operation of the reactor, and having nozzles for ejecting air- or gasflows towards the upper side of the plate 4.

In the embodiment shown, the cleansing device has the form of a U-shaped pipe configuration comprising two substantially horizontal pipe members 14 and 15 which are journalled centrally at the ceiling 5 of chamber 1 and immediately below the powder supporting plate 4, respectively, said horizontal pipe members being connected with each other through a single vertical pipe member 16. In the embodiment shown, all three pipe members 14, 15 and 16 are formed with nozzles for ejecting air or gas flows towards the underside of the chamber ceiling 5, the upper side of the powder supporting plate 4 and the innerside of the cylindrical wall of chamber 1, respectively.

However, the cleansing device may also consist solely of a single horizontal pipe member arranged immediately above the powder supporting plate, or of a L-shaped pipe configuration having two pipe members arranged in parallel relationship to the powder supporting plate and the vertical side wall, respectively.

The cleansing device is coupled to drive means 17 which may be an electric motor causing the cleansing device to rotate in the direction of revolution shown by an arrow at a velocity such as 3 r.p.m. The supply of air or gas to pipe members 14, 15 and 16 takes place through a supply pipe 18.

The nozzles for ejecting air or gas flows from pipe members 14, 15 and 16 may have the form, for instance, of simple holes in the sides of said pipe members facing the wall faces in question, such holes having a suitably small diameter for formation of cleaning air flows. The distance between the holes will depend, inter alia, on the distance of pipe members 14, 15 and 16 from the wall faces in question, the hole diameter and the pressure of cleaning air in supply pipe 18. For a hole diameter of about 2 mms, a mutual distance between the holes of abt. 20 mms will normally be suitable. The distance of the pipe members from the wall faces in question will be determined, on one hand, by tolerances in the mechanical construction of the chamber and, on the other hand, by the fact that in order to obtain an optimal cleaning effect, the air- or gas flows ejected from the holes must overlap each other before reaching the face to be cleaned. In practice, this distance may amount, for instance, to 20 mms.

Figure 2:
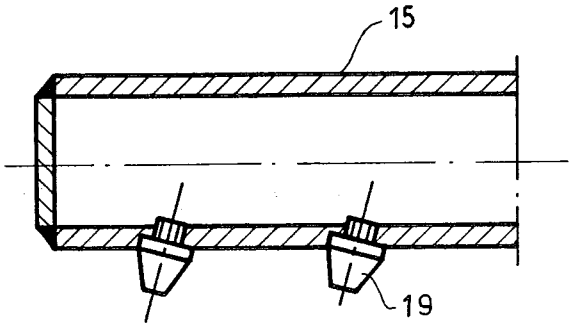

However, in particular for the pipe member 15 moving across the upper side of the powder supporting plate 4, it may be advantageous if the air- or gas ejecting nozzles, as shown in FIG. 2, are formed as inclined nozzles 19. Thereby, a directional ejection of air- or gas flows towards a powder outlet 20 formed in connection with the powder supporting plate 4 may be obtained, so that the cleansing device may simultaneously function as an evacuator when emptying the chamber 1. For a hole diameter of 1.5 mms in such nozzles, a mutual distance between the nozzles of abt. 50 mms would be suitable.

Figure 3:
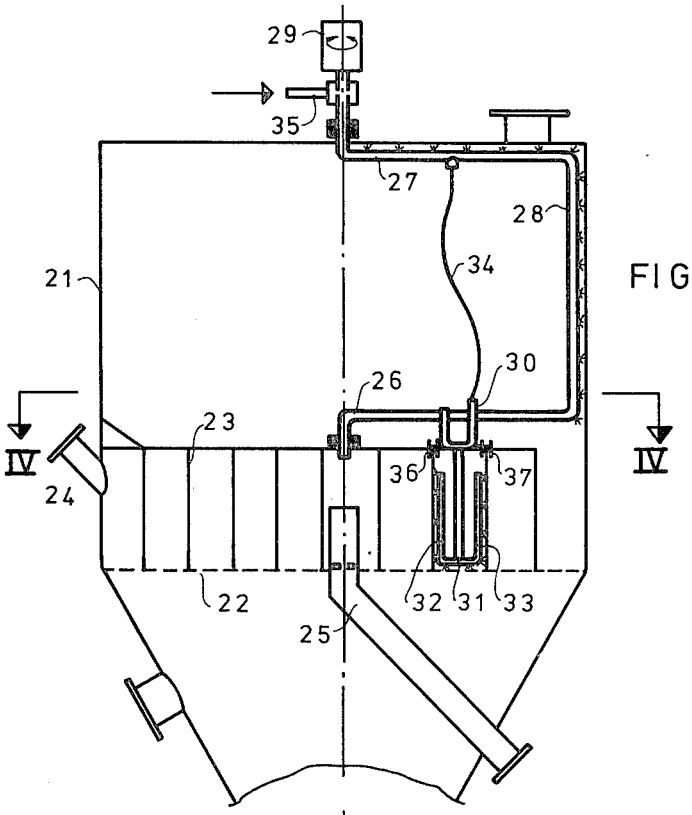
FIGS. 3 and 4 show a fluid bed reactor of the plug-flow type.
Figure 4:
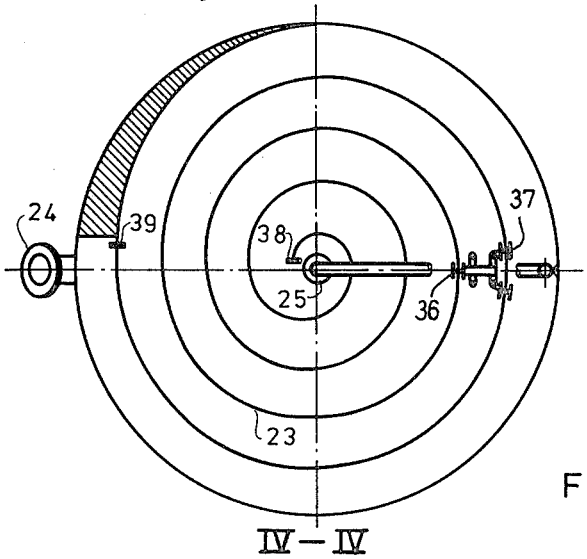

FIGS. 3 and 4 show a fluid bed reactor of the plug-flow type having a chamber 21 of the same principle form as in the reactor shown in FIG. 1, said chamber being shown in FIG. 3 in an axial sectional view, and in FIG. 4 in a cross-sectional view along the line IV—IV in FIG. 3. As mentioned in the foregoing, in such a reactor, a substantially vertical, spiral guiding wall 23 is arranged upon and directly connected with the powder supporting plate, which in this embodiment is designated by 22, said guiding wall having a height corresponding to that of the fluidized powder layer. The object of this construction is to cause the material in the fluidized layer to move continuously in a plug-flow through the helical path formed by the guiding wall after having been introduced in the central part of the chamber, or at the circumference thereof.

In the embodiment shown, the material is supplied through a powder inlet 24 in the outer part of the helical path at the circumference of chamber 21, and after processing the powder is taken out through an outlet pipe 25 opening in the central part of the chamber.

In this embodiment, the pneumatic cleansing device comprises, in the same manner as in FIG. 1, a generally U-shaped configuration of two centrally journalled, horizontal arms 26 and 27, which are connected with each other through a single vertical arm 28. Whereas the upper horizontal arm 27 and the vertical arm 28, in the same manner as in the embodiment of FIG. 1, are formed as pipe members having nozzles for ejecting air or gas flows towards the ceiling and the cylindrical wall of chamber 21, respectively, the lower horizontal arm 26 is closed and arranged above the spiral guiding wall 23, so that the cleansing device may be caused to rotate by drive means 29.

Since the lower horizontal arm 26 is positioned at a relatively great distance from the powder supporting plate 22, there is displaceably arranged on said arm, in order to obtain removal of material depositions from the upper side of the powder supporting plate 22 in the helical path formed by guiding wall 23, a cleansing device constructed for movement in said helical path and having a movable support 30 controlled by the upper edge of guiding wall 23 and carrying a U-shaped configuration of air or gas ejecting pipe members 31, 32 and 33, which are arranged at a small distance from the part of the upper side of supporting plate 22 situated in the helical path and the adjoining opposite side faces of the guiding wall. The air- or gas ejecting pipe members 31, 32 and 33 are connected through a flexible hose 34 to the upper horizontal pipe member 27, to which the cleaning air or gas is supplied through a supply pipe 35.

The movable support 30 is arranged on the lower horizontal arm 26 for displacement in the longitudinal direction thereof and is guided relative to the upper edge of the guiding wall 23 by three supporting wheels 36 and 37, which are mounted on the support 30 with a variable mutual separation in order to be able to follow possible variations in the width of the helical path.

At the ends of guiding wall 23 in the central part of the chamber and at the side wall thereof, stop means 38 and 39 for the movement of the cleansing device in the helical path are arranged, and the drive means 29 is constructed to reverse the rotation of the U-shaped configuration 26 to 28, when said stop means are engaged by the cleansing device.

Thus, in this embodiment of the cleansing device, substantially all wall faces in a fluid bed reactor of the plug-flow type will be continuously cleansed during operation of the reactor.

Figure 5:
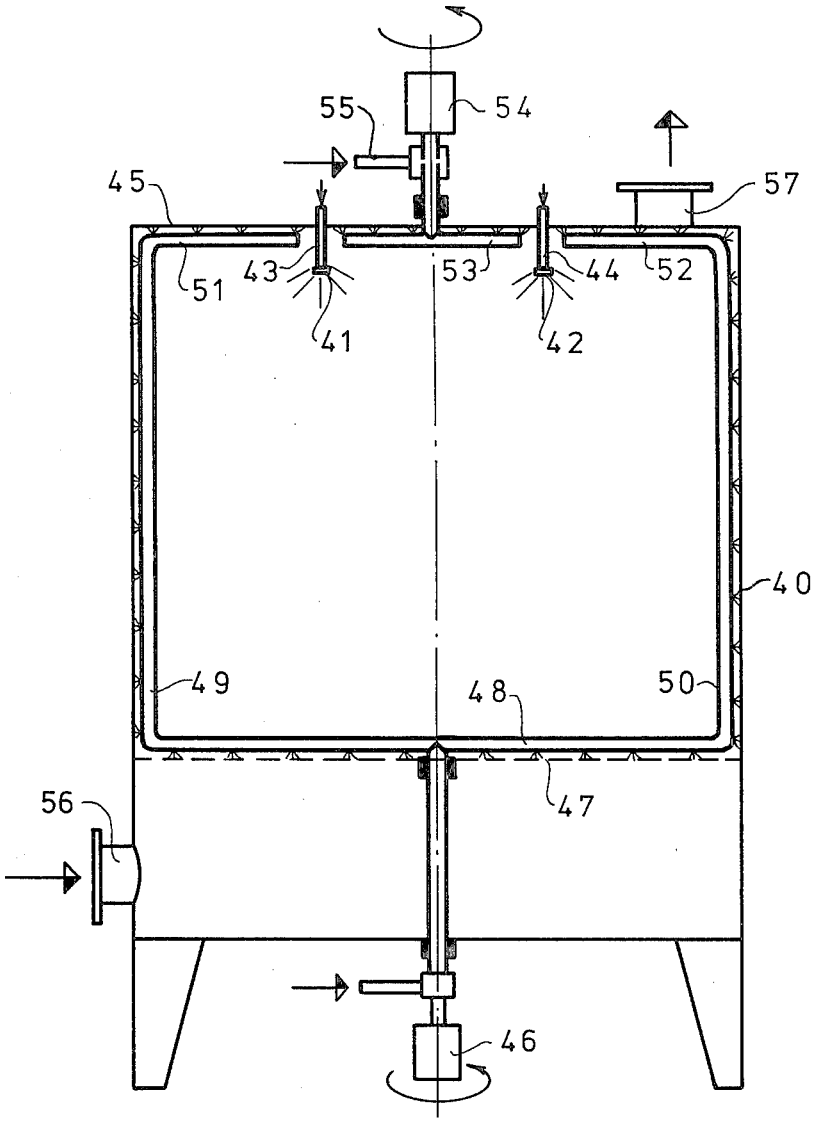
FIG. 5 shows a fluid bed reactor for spray-granulation.

FIG. 5 shows an embodiment of a cleansing device according to the invention used in a fluid bed reactor for spray granulation, in which the chamber 40, in the same manner as in the reactors shown in FIGS. 1 and 3, has a cylindrical shape. However, in the reactor shown in FIG. 5, the product to be processed is supplied in liquid form to two atomizer devices 41 and 42 in the upper part of chamber 40 through supply pipes 43 and 44, respectively, extending through the ceiling 45 of the chamber.

In the same manner as in the embodiment described in the foregoing, the cleansing device is centrally journalled in the chamber 40 and may be caused to rotate in the direction of revolution shown by an arrow by a drive means 46, which in this case, however, is arranged below the powder supporting plate 47. Furthermore, of the pipe members serving for ejecting air- or gas flows towards the upper side of the powder supporting plate 47 and the wall and ceiling faces of the chamber 40, the lower horizontal pipe member 48 has a length corresponding to the diameter of chamber 40 and is connected at its ends with two vertical pipe members 49 and 50 arranged diametrically opposite each other, to the upper ends of which vertical pipe members there is connected upper horizontal pipe members 51 and 52, respectively, having such a length that during rotation of the cleansing device they will not interfere with the supply pipes 43 and 44 extending through the chamber ceiling 45.

For the object of cleaning the part of the chamber ceiling 45 situated between the supply pipes 43 and 44, there may be provided a further cleansing device comprising a single horizontal pipe member 53 journalled centrally in the ceiling and being coupled to a separate drive means 54, as well as a separate air or gas supply pipe 55.

The fluidization gas is supplied through a gas inlet 56 and leaves the chamber 40 through a gas outlet 57.

Figure 6:
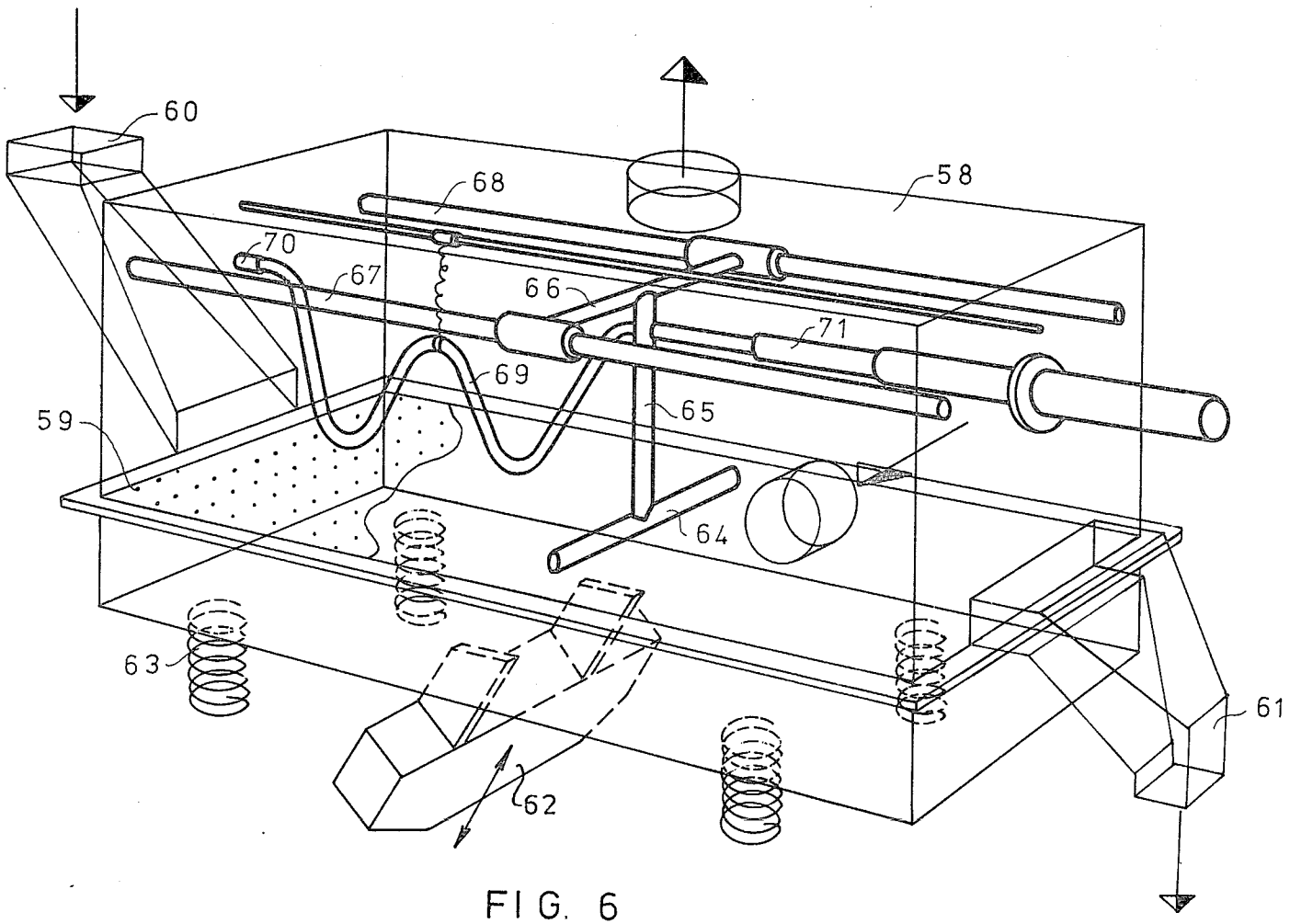
FIG. 6 shows a reactor having a vibrating, box-shaped chamber.

FIG. 6 shows an embodiment of the cleansing device according to the invention used in a fluid bed reactor having a box-shaped chamber 58 with a rectangular powder supporting plate 59.

The powder to be processed is supplied through a funnel 60 at one end of chamber 58, and after processing the powder is evacuated from the chamber through a funnel 61 in the opposite end of the chamber. In the example illustrated, a vibrating fluid bed reactor is shown, in which the entire chamber 58 including the powder supporting plate 59 may be caused into vibrate by means of a vibrator 62, the chamber 58 being supported by heavy helical strings 63.

In this embodiment, the cleansing device has a horizontal pipe member 64 for ejecting air- or gas flows towards the upper side of the supporting 59, which pipe member by means of closed pipe members 65 and 66 is mounted for linear reciprocating movement in the longitudinal direction of chamber 58 on guide rails 67 and 68 arranged above the fluidized layer. Cleaning air or gas is supplied through a flexible hose 69, which in one end is connected to the vertical pipe member 65 in the cleaning device and is connected in the other end through an air- or gas supply line 70.

The linear reciprocating movement of the cleansing device may be obtained, for instance, by a drive means having a displaceable reversing hydraulic plunger 71.

Although it is not shown in the figures for reasons of clarity, the cleansing device according to the invention will without difficulty be usable in combination with a movable cleansing device for the underside of the powder supporting plate, such as disclosed in the abovementioned U.S. Pat. No. 3,780,445.

Furthermore, the fluid bed reactors shown in the figures represent only examples of applications of a pneumatic cleansing device according to the invention. The cleansing device may be applied in practically any form of such reactors, i.e. also in multi-stage reactors, in which a cleansing device of the kind referred to may be associated with the upper side of each powder supporting plate.

Likewise, the cleansing device may advantageously be applied in any of the reaction processes carried out in fluid bed reactors, i.e. in drying processes possibly in combination with agglomeration or granulation, or in other physical or chemical processes.

However, the cleansing device according to the invention is particularly advantageous in processing such products which in themselves show a notable tendency to agglomeration, or in processes which are particularly critical with respect to the risk of material depositions. An example of such process is a fluidization process for gas phase polymerization of olefines, such as disclosed in Australian Pat. No. 428,571.

In the following, concrete examples are given on fluidization of products having critical properties of the kind, for which a cleansing device according to the invention will have a particularly advantageous effect.

EXAMPLE 1

In a fluid bed reactor having a cylindrical chamber with a cross-sectional area of 0.1 $m^2$, an experimental drying process was carried out with 10 kgs wet chlorinated polyethylene of a composition of 6.7 kgs of solid matter and 3.3 kgs of water and the following particle distribution:

| Particle size | Percentage by weight |
|---|---|
| >3000 microns | 2.5 |
| 2000–3000 microns | 12.5 |
| 1000–2000 microns | 62.5 |
| 750–1000 microns | 21.0 |
| 500–750 microns | 1.0 |
| 250–500 microns | 0.5 |
| <250 microns | 0 |

On the condition that it was desired to dry the product to a residial humidity of 0.1 weight percent, drying experiments were carried out, on one hand without the use of cleaning measures for the removal of material depositions, and, on the other hand, with the use of a cleansing device according to the invention.

In both experiments, drying air having a dew point at 23° C. was supplied in an amount of 354 kgs per hour. In the first experiment without cleaning measures, depositions of adhered material to a thickness of 5 to 10 cms occurred on the internal surfaces of the chamber particularly at the junction between the powder supporting plate and the wall and on the wall, even at an inlet temperature of the drying air of 50° to 60° C. The desired drying result could not be achieved within reasonable time, and emptying the product of the reactor was difficult.

Thereafter, a cleansing device according to the invention was arranged in the reactor chamber, said cleansing device comprising a L-shaped configuration having two arms, one of which was journalled centrally above the powder supporting plate and had a length corresponding to the radius of the chamber, whereas the other arm extended along the wall above the fluidised layer. The cleansing arms had together 24 nozzles of a diameter of 1 mm and a mutual distance of 20 mms and rotated at a velocity of 3 r.p.m. The cleansing arms were supplied with air in the amount of 34.4 kgs per hour.

Using drying air of the same dew point and in the same quantity as in the first experiment, it was now possible to supply the drying air of an inlet temperature of 88° C., and the residual humidity aimed at was obtained after a drying period of 120 minutes at a final powder temperature of 84° C. The drying process developed without the formation of depositions or adhesions of the product, and after the process the reactor was emptied without difficulty under continuous rotation of the cleansing device, and without further measures.

EXAMPLE 2

In a fluid bed reactor having a cylindrical chamber with a cross-sectional area of 1 $m^2$, experiments were carried out with an adhesive type of polypropylene containing 0.5% heptane. It was desired to dry the product to a heptane content of 0.05%.

A quantity of 198 kgs of the material was heated to 110° C. by supplying air at 115° C. in an amount of 1750 kgs per hour. Total drying time was 1 hour. The starting material had the following particle distribution:

| Particle size | Percentage by weight |
|---|---|
| >2000 microns | 8.0 |
| 1000–2000 microns | 9.0 |
| 750–1000 microns | 9.5 |
| 500–750 microns | 12.5 |
| 420–500 microns | 6.0 |
| 250–420 microns | 25.0 |
| 177–250 microns | 5.0 |
| 120–177 microns | 20.0 |
| <120 microns | 5.0 |

Without the use of a cleansing device, a caked layer of a thickness of 10 cms was found on the perforated plate when emptying the reactor, and the walls of the reactor chamber were covered by depositions of a thickness of 1 to 2 cms.

After installation in the reactor chamber of a cleansing device according to the invention and consisting of a horizontal and a vertical pipe member having an internal diameter of 16 mms and coupled with a drive means and air supply means arranged below the supporting plate, the experiment was repeated. On the cleaning arm, nozzles of a diameter of 1.5 mms were mounted in a mutual distance of 5 cms, so that there were 11 nozzles on the horizontal arm and 16 nozzles on the vertical arm. The nozzles on the vertical arm were inclined 30° downwardsly from the horizontal direction and pointing 30° forward from the tangential direction. The nozzles in the horizontal arm were inclined 30° downwardly from the horizontal direction and pointed outwardly 30° from the tangential direction, the nozzle closest to the circumference pointing, however, exactly tangential. The distance from each nozzle orifice to the wall or the supporting plate was 25 mms.

Near the circumference of the perforated plate, the chamber had an outlet of a diameter of 150 mms. Pressurized air of a temperature of 110° C. and an air pressure of 0.8 bar was supplied to the nozzles.

The cleansing device rotated at a velocity of 3 r.p.m.

Immediately after emptying of the chamber, the wall was found to be free of depositions, whereas the perforated plate was covered by a layer of coarse particles of a thichness of 2 cms, which layer, however, after about 2 minutes was removed by the cleansing device. After this, the perforated plate was completely clean.

What is claimed is:

1. In a fluidized bed reacting apparatus for processing a powdered product and including a chamber having inlet means for said product, at least one perforated powder supporting plate arranged in a substantially horizontal plane in said chamber, and means arranged in a portion of the chamber below said plate for producing a flow of fluidizing gas upwardly through the perforations in said plate for the formation of a fluidized layer of said product through part of the height of said chamber overlying said plate, an improved movable pneumatic cleansing device for removing depositions of said product from one or more wall faces of said chamber by directing gas jets towards said wall faces, which cleansing device is connected with drive means and supply means for gas, characterized by: at least one pipe member disposed above said perforated plate in parallel relationship to and spaced a short distance from the upper side thereof, said pipe member being constructed for movement across the upper surface of said plate during operation of said reacting apparatus and having a plurality of nozzles for directing gas jets towards the upper side of said plate in a direction generally opposite to said flow of fluidizing gas upwardly through the perforations in said plate.

2. In a fluidized bed reacting apparatus as recited in claim 1 and comprising a chamber having a cylindrical side wall and a substantially flat ceiling connected with said side wall, the pipe member of said cleansing device being journalled centrally in said chamber and being connected with said drive means for rotation around the axis of the chamber, said pipe member having a length corresponding to the radius of said chamber and forming a bottom leg of a substantially C-shaped pipe configuration, the intermediate leg and the top leg of which are constituted by two additional pipe members arranged in parallel relationship to and at a small distance from the inner faces of the side wall and ceiling of said chamber, respectively, and having nozzles for directing gas jets towards said inner faces.

3. In a fluidized bed reacting apparatus as recited in claim 1, said apparatus being of the plug-flow type comprising a chamber having a cylindrical side wall and a substantially flat ceiling, in which a substantially vertical spiral guiding wall is arranged upon and directly connected with said perforated plate, said guiding wall extending to a height in said chamber corresponding to said fluidized layer, the pipe member of said cleansing device constituting the bottom member of a substantially U-shaped pipe configuration arranged for movement in the helical path formed by said guiding wall, the members of which U-shaped configuration are constituted by additional pipe members constructed for ejecting air or gas flows towards opposite side faces of successive windings of said guiding wall, said U-shaped configuration being displaceably arranged on an arm which is journalled centrally in said chamber above said guiding wall and in parallel relationship to said perforated plate, said arm being connected with said drive means and means being provided for guiding the movement of said U-shaped configuration relative to the upper edge of said guiding wall during rotation of said arm around the axis of said chamber, stop means for the movement of said U-shaped configuration being provided at the ends of said guiding wall in the central part of said chamber and at the side wall thereof, said drive means being contructed for reversing the rotation of said arm when said stop means are engaged by said pipe configuration.

4. In a fluidized bed reacting apparatus as recited in claim 3, further pipe members being connected with said arm and arranged in parallel relationship to and at a small distance from the inner side of the side wall and ceiling of said chamber, respectively, said pipe members being provided with nozzles for ejecting air or gas flows towards the inner faces of said side wall and said ceiling.

5. In a fluidized bed reacting apparatus as recited in claim 1 and comprising a chamber having a cylindrical side wall and a substantially flat ceiling connected with said side wall and provided with excentric openings for the arrangement of said inlet means, and atomizing devices for said product being arranged in the upper part of said chamber in connection with said inlet means, the pipe member of said cleansing device having a length corresponding substantially to the diameter of said chamber and being connected at each of its ends with additional vertical pipe members arranged in parallel relationship and at a small distance from the inner face of said side wall and being provided with nozzles for ejecting air or gas flows towards said inner face, the opposite ends of said vertical members being connected with further horizontal pipe members arranged in parallel relationship to and at a small distance from the inner face of said ceiling, said further pipe members being provided with nozzles for ejecting air or gas flows towards said inner face and having a length so as to avoid interference with said inlet means during rotation of said cleansing device.

6. In a fluidized bed reacting apparatus as recited in claim 1 and comprising a box-sahped chamber having substantially flat side walls and end walls, said cleansing device being constructed and arranged for linear reciprocating movement in the longitudinal direction of said chamber, at least one guide rail being arranged in the part of said chamber overlying said fluidized layer for guiding said reciprocating movement, said pipe member being connected with said air or gas supply means through a flexible hose.

* * * * *